US006367539B1

(12) United States Patent
Poloni et al.

(10) Patent No.: US 6,367,539 B1
(45) Date of Patent: Apr. 9, 2002

(54) CRYSTALLISER FOR CONTINUOUS CASTING

(75) Inventors: Alfredo Poloni, Fogliano Di Redipuglia; Milorad Pavlicevic; Nuredin Kapaj, both of Udine, all of (IT)

(73) Assignee: Danieli & C. Officine Meccaniche SpA, Buttrio (UD) (IT)

( * ) Notice: Subject to any disclaimer, the term of this patent is extended or adjusted under 35 U.S.C. 154(b) by 0 days.

(21) Appl. No.: 09/479,848

(22) Filed: Jan. 10, 2000

(30) Foreign Application Priority Data

Jan. 13, 1999 (IT) ..... UD99A0001

(51) Int. Cl.[7] ..... B22D 11/124; B22D 27/04
(52) U.S. Cl. ..... 164/443; 164/418; 164/348
(58) Field of Search ..... 164/418, 459, 164/443, 485, 348

(56) References Cited

U.S. PATENT DOCUMENTS

| | | | | |
|---|---|---|---|---|
| 3,763,920 A | | 10/1973 | Auman et al. | |
| 4,669,529 A | | 6/1987 | Evertz | |
| 5,526,869 A | * | 6/1996 | Sears, Jr. | 164/443 |
| 5,762,127 A | * | 6/1998 | Benedetti et al. | 164/485 |
| 5,771,958 A | * | 6/1998 | Sears, Jr. | 164/443 |

FOREIGN PATENT DOCUMENTS

| | | | |
|---|---|---|---|
| DE | 2829010 | | 1/1980 |
| EP | 0686446 | | 12/1995 |
| FR | 1443574 | | 10/1966 |
| GB | 954719 | | 4/1964 |
| GB | 2017551 A | * | 3/1979 |

OTHER PUBLICATIONS

Database WPI, Section Ch, Week 8830, Derwent Publications Ltd., London, GB; AN 88–212272 & SU 1366282, Jan. 15, 1988.

* cited by examiner

*Primary Examiner*—M. Alexandra Elve
*Assistant Examiner*—Len Tran
(74) *Attorney, Agent, or Firm*—Stevens, Davis, Miller & Mosher, LLP

(57) ABSTRACT

Crystalliser for continuous casting of billets and blooms, including a monolithic tubular structure whose transverse section defines the section shape of the cast product, said tubular structure including a wall defined by an outer face and an inner face located in contact with the cast metal, said crystalliser including holes for the transit of cooling liquid, made in the thickness of the wall of the monolithic tubular structure, said holes being made on said wall in such a manner that the distance ("d") between their longitudinal axis and the inner face of the wall of the crystalliser is between 5 and 20 mm.

27 Claims, 3 Drawing Sheets

CRYSTALLISER FOR CONTINUOUS CASTING

FIELD OF THE INVENTION

This invention concerns a crystalliser for continuous casting as set forth in the main claim.

The crystalliser according to the invention is applied in the high speed continuous casting of billets and blooms of any type and section, and is used to obtain products of a high inner and surface quality.

BACKGROUND OF THE INVENTION

In the state of the art of continuous casting, tubular crystallisers are used as an alternative to plate crystallisers, and consist of a substantially monolithic hollow body, the transverse section of which defines the section of the cast product.

To cool the molten metal cast inside the crystalliser, and hence to begin the progressive solidification of the metal, the state of the art provides a jacket outside the walls of the crystalliser which defines a transit compartment inside which a cooling liquid is made to pass.

This embodiment, which is widely known and used, has some disadvantages.

To guarantee an adequate structural rigidity of the crystalliser, also because crystallisers used at present are relatively limited in length, in order to prevent deformations due to the thermal and mechanical stresses during the casting process, the wall of the crystalliser must have a defined minimum thickness.

At present, crystallisers usually used have a length of less than 1000 mm and walls with a minimum thickness of around 13 mm, and in any case about 10% of the width of the billet or bloom cast.

As the casting speed increases, the thermal flow exchanged between the cooling liquid and the molten metal also consequently increases, and therefore the thermal flow which is transmitted through the walls of the crystalliser.

Moreover, because of the great thickness of the walls, there is a considerable difference between the temperature of the outer face and the temperature of the inner face of the crystalliser.

The thermal conditions which are created in the walls of the crystalliser considerably lower the mechanical properties, particularly the structural rigidity, of the material of which the crystalliser is made (copper or copper alloys), and this causes permanent deformations and distortions which create considerable technological problems and problems of quality in the cast product.

First of all, the deformations and distortions cause a modification to the inner taper along the crystalliser, which becomes progressively very different from the taper specified by the design plans, with the consequence that the inner cavity of the crystalliser no longer correctly follows the shrinkage of the solidifying skin.

This causes considerable problems in the quality of the cast product and it becomes necessary to reduce the casting speed. Moreover, the deformations and distortions can also cause a modification to the transverse section of the crystalliser, thus determining both surface and internal defects in the cast product.

Furthermore, the deformations and distortions shorten the working life of the crystalliser.

A further disadvantage which is particularly serious is that permanent deformations and distortions are generated in the area of the meniscus.

In fact, in this area uncontrolled interactions are created between the walls of the crystalliser and the skin which is forming; this causes the formation of deep oscillation marks on the surface of the cast product, an uncontrollable heat exchange, defects in the planarity of the skin, inner cracks in the areas near the corners which can cause risks of the skin breaking at the outlet of the crystalliser, and a leakage of the liquid metal.

Another serious disadvantage of monolithic crystallisers comes from the behavior of the cast product in correspondence with the corners. Since in this area the cooling acts on both sides, the skin tends to shrink in a differentiated manner, with the result that it is impossible to form the desired thickness and phenomena may occur such as the skin breaking at the outlet of the crystalliser.

In either case, the skin formed is not uniform and there are both surface and inner defects in the product.

The present Applicant has devised and embodied this invention to overcome these shortcomings and to obtain further advantages as will be shown hereafter.

SUMMARY OF THE INVENTION

The invention is set forth and characterised in the main claim, while the dependent claims describe other innovative characteristics of the invention.

The purpose of the invention is to achieve a crystalliser for continuous casting suitable to guarantee a great structural rigidity such as to eliminate the risks of permanent deformations and distortions even when there are extremely high heat stresses due to the intense heat exchange between the cooling liquid and the molten metal.

This structural rigidity is obtained without reducing the cooling capacity required for a correct solidification of the cast metal even at high casting speeds.

The crystalliser according to the invention has a monolithic tubular structure consisting of a wall with an outer face and an inner face in contact with the cast molten metal.

According to the invention, the crystalliser has through holes, made in the thickness of its wall, inside which the cooling liquid is made to circulate.

Therefore, the distance between the cooling liquid and the molten metal is reduced, yet without reducing the overall thickness of the wall of the crystalliser and therefore its mechanical and structural rigidity.

To be more exact, the holes are arranged so as to have their longitudinal axis at a distance of between 5 and 20 mm, advantageously between 7 and 15 mm, from the inner face of the crystalliser and therefore substantially from the liquid metal.

Thanks to the presence of the cooling liquid inside the wall of the crystalliser, it is possible to obtain a lower average temperature of the wall, thus reducing the heat stresses which lead to permanent deformations and distortions.

Moreover, there is a considerable reduction in the difference between the temperature of the face of the wall in contact with the cooling liquid and that of the inner face in contact with the molten metal.

All this allows to contain the deformations and distortions inside an elastic field, thus allowing to recover the original shape when the stresses are finished.

The crystalliser according to the invention is longer than 1000 mm, advantageously between 1050 and 1500 mm.

This increased length, together with the holes made directly in the monolithic structure of the crystalliser which allow to maintain the width of the wall at a certain value, gives great rigidity and resistance to mechanical and thermal stress.

The advantages which this solution according to the invention brings are, first of all, that the inner taper of the crystalliser remains according to specifications, and is therefore configured to follow the shrinkage of the cast product during solidification.

It is thus possible to maintain the high quality characteristics of the cast product, and to keep the casting speed high, thus obtaining high productivity.

Moreover, the possible causes of defects in the product are eliminated, such as lack of planarity, the presence of cracks near the corners, the formation of deep oscillation marks.

Furthermore, the working life of the crystalliser is extended.

The crystalliser according to the invention consists of a monolithic body of the tubular type, the inner cavity of which defines the section of the cast product.

According to a variant, the cooling in the corners of the crystalliser is controlled in a different manner from its plane zones.

This allows to appropriately condition the shrinkage of the cast product in correspondence with the corners, which shrinkage is faster than in the plane zones since the cooling acts simultaneously from two sides of the corner.

According to one embodiment of the invention, in correspondence with the corner, the cooling liquid does not flow through the holes made in the walls with the same volume and/or pressure as the liquid passing in the plane zones of the crystalliser.

According to a variant, the holes in correspondence with the corners are provided with a lower density with respect to the plane zones of the tubular wall of the crystalliser.

According to a further variant, the holes in correspondence with the corners are provided with a different shape, for example of a lesser section, with respect to the plane zones of the tubular wall of the crystalliser.

According to another characteristic of the invention, in correspondence with the corners, the wall of the crystalliser has reinforcement and stiffening inserts, or segments with a greater thickness, suitable to guarantee a greater rigidity in correspondence with the zones more subject to stresses, and also a lesser heat exchange.

BRIEF DESCRIPTION OF THE DRAWINGS

The attached Figures are given as a non-restrictive example, and show some preferential embodiments of the invention as follows.

DETAILED DESCRIPTION OF PREFERRED EMBODIMENTS

Figure 1:
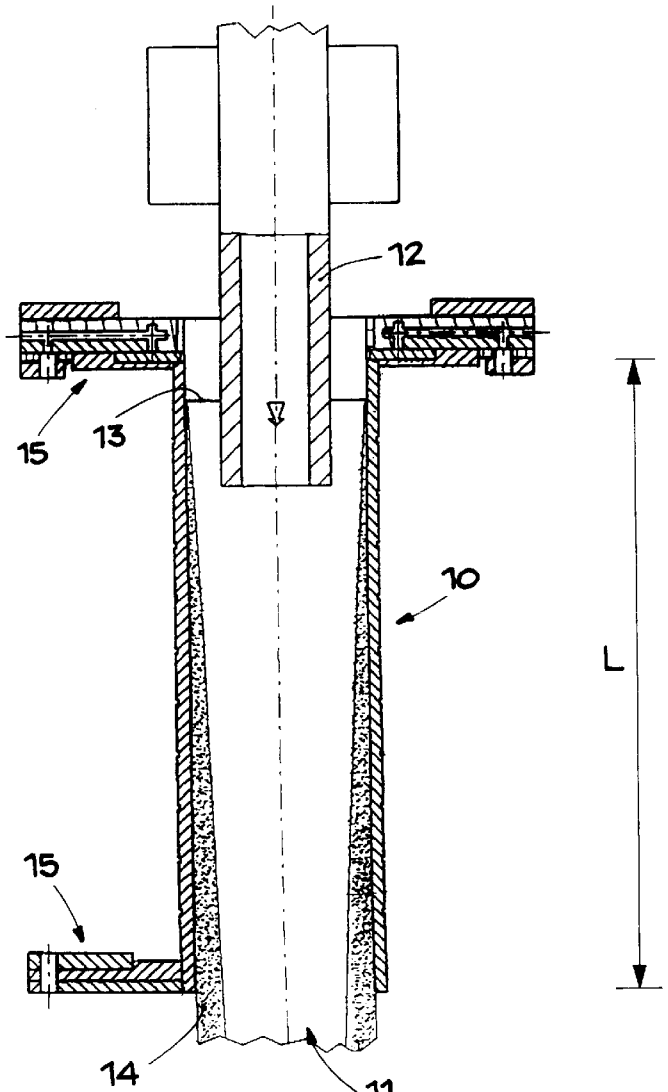
FIG. 1 shows a longitudinal section of a crystalliser for continuous casting according to the invention.
Figure 2:
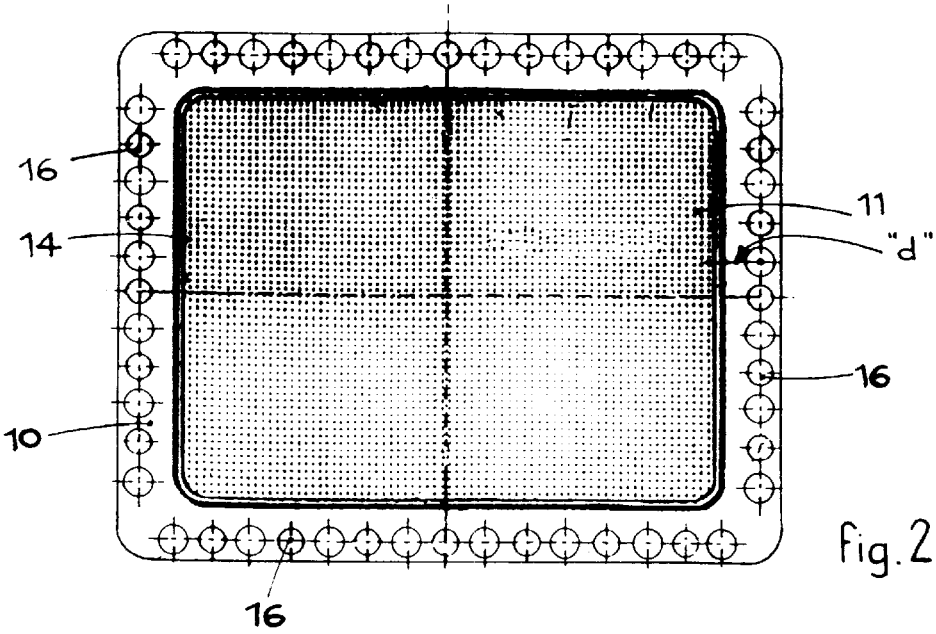
FIG. 2 is a cross section of the crystalliser shown in FIG. 1.

FIG. 1 shows partly and in diagram form a longitudinal section of a crystalliser 10 of the monolithic tubular type for the continuous casting of billets or blooms 11.

The molten metal, cast continuously by means of a nozzle 12, progressively solidifies starting from the zone of the meniscus 13 creating a thickness of skin 14 which progressively grows as it goes towards the outlet of the crystalliser 10.

The crystalliser 10 cooperates in a manner known to the state of the art with support means 15 suitable to be associated with mechanical oscillation means, which are not shown here.

The crystalliser 10 defines an inner tapering cavity, suitable to adapt to the shrinkage of the skin 14 as it gradually solidifies.

The taper can be continuous and assume a substantially parabolic development, or it can be defined by multi-taper segments joined together.

The crystalliser 10 according to the invention consists of a monolithic structure with a length "L" of between 1050 and 1500 mm.

According to the invention, inside the tubular wall of the crystalliser 10 longitudinal holes 16 are made which extend vertically, parallel to each other, substantially for the whole height of the crystalliser 10, inside which the cooling liquid, usually consisting of water, is made to circulate.

According to a variant, the holes 16 are sloping with respect to the longitudinal development of the crystalliser 10. The longitudinal holes 16, in a first embodiment, are circular and between 8 and 16 mm in diameter.

Thanks to the holes 16 made directly in the wall of the tubular crystalliser 10, it is possible to take the cooling liquid nearer to the liquid metal, yet still maintain a good thickness of wall which, together with the great length "L" of the crystalliser 10 itself, ensures the necessary structural rigidity and resistance to deformations and distortions caused by thermal and mechanical stresses.

According to the invention, in order to optimise the heat exchange between the cooling liquid and liquid metal, the distance "d" between the longitudinal axis of the holes 16 and the inner wall of the crystalliser 10 is between 5 and 20 mm, advantageously between 7 and 15 mm.

Figure 3:
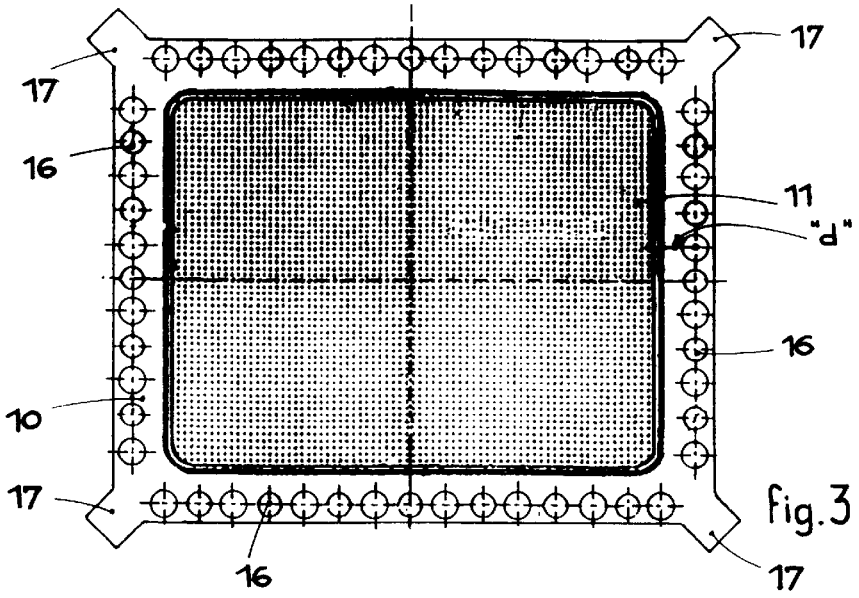
FIG. 3 shows a first variant of FIG. 2.

The variant shown in FIG. 3 shows an embodiment where, in correspondence with the corners 20, the crystalliser 10 has segments of a greater thickness 17 which make the monolithic structure of the crystalliser 10 even more rigid.

Figure 4:
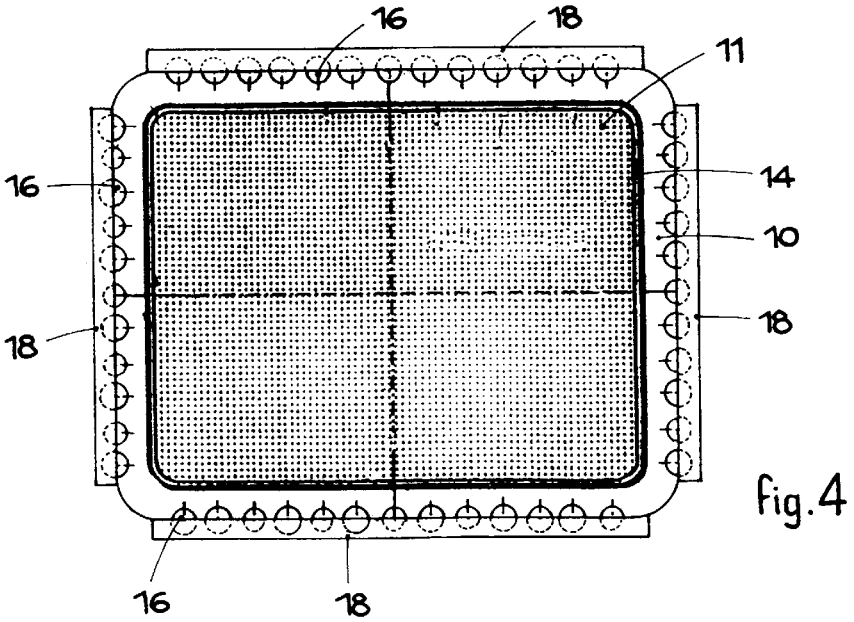
FIG. 4 shows a second variant of FIG. 2.

The further variant shown in FIG. 4 shows an embodiment where the longitudinal holes 16 wherein the cooling liquid circulates are obtained by making semicircular parallel shapings on the outer faces of the crystalliser 10, which are then closed from the outside by containing plates 18. With this embodiment it is easier to make the holes 16 on the walls of the crystalliser 10.

According to a variant shown with a line of dashes, on their inner face the plates 18 have semicircular shapings mating with the shapings of the crystalliser 10 which couple with them to form circular holes 16 through which the cooling liquid can pass.

According to a variant, the cooling system is regulated in a differentiated manner in correspondence with the corners 20 of the crystalliser 10 in order to control the shrinkage of the skin 14 due to the different cooling conditions which occur in correspondence and in proximity of the corners 20.

Figure 5A:
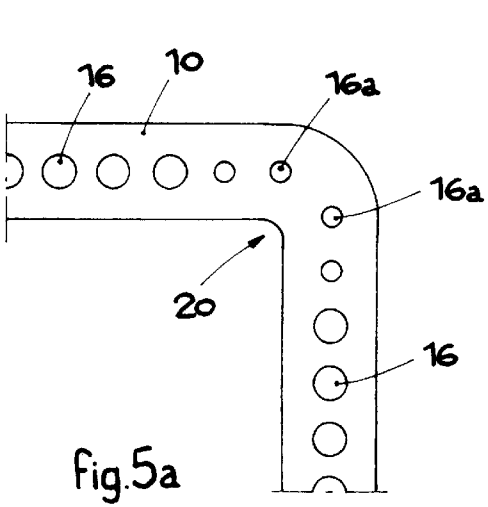
FIGS. 5*a* and 5*b* show, with two variants, the detail of the corner zone of the crystalliser shown in FIG. 2.

In the embodiment shown in FIG. 5*a*, which shows the detail of a corner 20 of the tubular crystalliser 10 according to the invention, the holes 16*a* for the passage of cooling liquid located in correspondence or in close proximity with the corner 20 are smaller in section than the holes 16 provided along the plane parts of the crystalliser 10.

With this embodiment a lesser volume of the cooling liquid is delivered in correspondence with the corner 20 and therefore the capacity to remove heat is reduced; as a consequence the cooling parameters are made uniform with respect to the plane faces of the crystalliser 10.

According to a variant which is not shown here, the holes 16*a* in correspondence with the corner 20 are fed with a flow of water which is modulated, in volume or pressure, according to the specific cooling requirements of the corner zone.

Figure 5B:
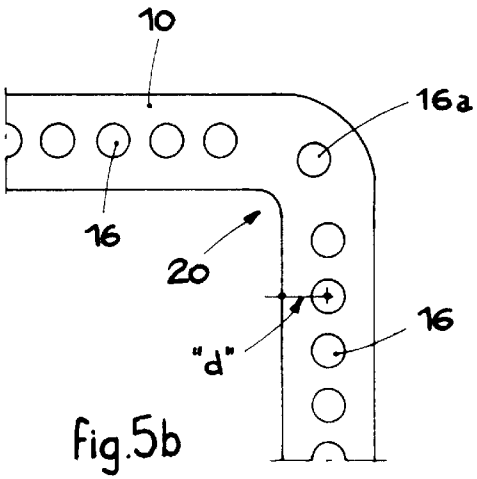

According to the further variant shown in FIG. 5*b*, the holes 16*a* in correspondence with the corner are less dense than the holes 16 on the plane faces of the crystalliser 10.

Figure 6A:
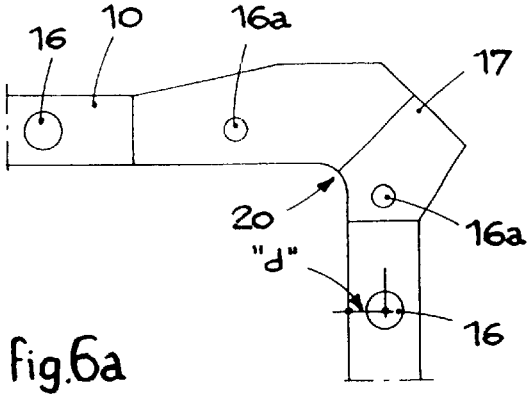
FIGS. 6*a* and 6*b* show two variants of FIGS. 5*a* and 5*b;*
Figure 6B:
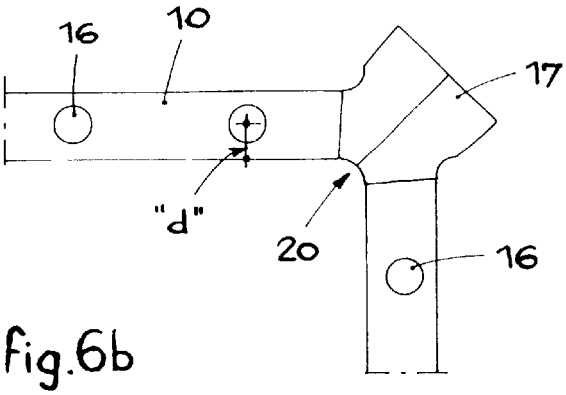

The variants shown in FIGS. 6*a* and 6*b* show embodiments wherein, in correspondence with the corner 20, the crystalliser 10 has segments of a greater thickness 17 which have the function both of making the crystalliser 10 more rigid in those areas which are most subjected to stress, and also of reducing the heat exchange with the cooling liquid circulating in the holes 16*a*.

Figure 7A:
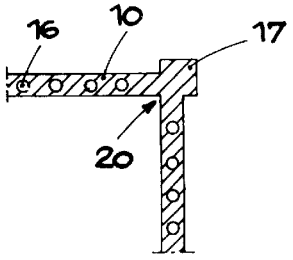
FIGS. 7*a*, 7*b* and 7*c* show three more embodiments for the corner zones of the crystalliser according to the invention.
Figure 7B:
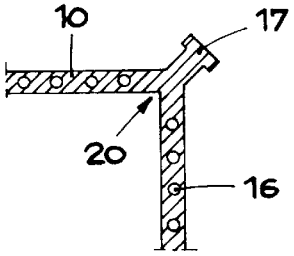
Figure 7C:
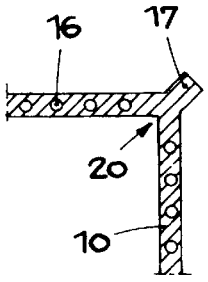

FIGS. 7*a*, 7*b* and 7*c* show other examples of segments with a greater thickness 17 made in correspondence with the corners 20 of the crystalliser 10.

The segments with a greater thickness 17 may be of various shape, for example dove-tailed, parallelepiped or otherwise, and may or may not be provided with holes 16 where cooling liquid circulates.

What is claimed is:

1. A crystalliser for continuous casting of billets and blooms, including a monolithic tubular structure whose transverse section defines the section shape of the cast product, the tubular structure including a wall defined by an outer face and an inner face located in contact with the cast metal, said crystalliser including holes for the transit of cooling liquid, made in the thickness of the wall of the monolithic tubular structure, wherein said holes are made on said wall in such a manner that the distance ("d") between their longitudinal axis and the inner face of the wall of the crystalliser is between 5 and 20 mm, wherein said crystalliser has a length "L" of more than 1000 mm.

2. The crystalliser as in claim 1, wherein said distance ("d") is between 7 and 15 mm.

3. The crystalliser as in claim 1, wherein said crystalliser has a length "L" of between 1050 and 1500 mm.

4. The crystalliser as in claim 1, wherein said holes are substantially circular and extend longitudinally, parallel to each other, for the entire height of the crystalliser.

5. The crystalliser as in claim 4, wherein the holes are between 8 and 16 mm in diameter.

6. The crystalliser as in claim 1, wherein said holes are semicircular in shape, are made on the outer face of the crystalliser and cooperate with outer closing plates.

7. The crystalliser as in claim 6, wherein said outer plates have semicircular shapings mating with said semicircular holes on the outer face of the crystalliser so as to define, in coupling therewith, circular transit holes.

8. The crystalliser as in claim 1, comprising corners associated with a cooling system which is differentiated with respect to the plane zones.

9. The crystalliser as in claim 8, comprising holes in correspondence with the corners, said holes having a smaller section than that of the holes in the plane zones.

10. The crystalliser as in claim 8, comprising holes in correspondence with the corners, said holes having a lesser density than that of the holes in the plane zones.

11. The crystalliser as in claim 10, wherein in correspondence with the corners said holes are fed with a flow of water with different parameters, in terms of delivery and/or pressure, with respect to the holes in the plane zones.

12. The crystalliser as in claim 1, comprising segments in correspondence with the corners, said segments having a greater thickness to make the structure more rigid.

13. The crystalliser as in claim 2, wherein said crystalliser has a length "L" of between 1050 and 1500 mm.

14. The crystalliser as in claim 2, wherein said holes are substantially circular and extend longitudinally, parallel to each other, for the entire height of the crystalliser.

15. The crystalliser as in claim 3, wherein said holes are substantially circular and extend longitudinally, parallel to each other, for the entire height of the crystalliser.

16. The crystalliser as in claim 2, wherein said holes are semicircular in shape, are made on the outer face of the crystalliser and cooperate with outer closing plates.

17. The crystalliser as in claim 3, wherein said holes are semicircular in shape, are made on the outer face of the crystalliser and cooperate with outer closing plates.

18. The crystalliser of claim 1, wherein all of the holes for the transit of cooling fluid are longitudinally arranged.

19. The crystalliser of claim 1, wherein at least one transverse cross-section of the monolithic tubular structure intersects all the holes for the transit of cooling fluid.

20. The crystalliser of claim 1, wherein all the holes for the transit of cooling fluid extend vertically parallel to each other.

21. The crystalliser as in claim 2, comprising corners associated with a cooling system which is differentiated with respect to the plane zones.

22. The crystalliser as in claim 3, comprising corners associated with a cooling system which is differentiated with respect to the plane zones.

23. The crystalliser as in claim 4, comprising corners associated with a cooling system which is differentiated with respect to the plane zones.

24. The crystalliser as in claim 1, wherein said crystalliser has a length "L" of between 1000 and 1500 mm.

25. A crystalliser for continuous casting of billets and blooms, including a monolithic tubular structure whose transverse section defines the section shape of the cast product, the tubular structure including a wall defined by an outer face and an inner face located in contact with the cast metal, said crystalliser including holes for the transit of cooling liquid, made in the thickness of the wall of the monolithic tubular structure, wherein said holes are made on said wall in such a manner that the distance ("d") between their longitudinal axis and the inner face of the wall of the crystalliser is between 5 and 20 mm, and wherein the holes are between 8 and 16 mm in diameter.

26. The crystalliser as in claim 25, wherein said holes are substantially circular and extend longitudinally for the entire height of the crystalliser.

27. The crystalliser as in claim 25, wherein said holes are substantially circular and extend longitudinally, parallel to each other, for the entire height of the crystalliser.

* * * * *